US005794268A

United States Patent [19]

Pessey

[11] Patent Number: 5,794,268

[45] Date of Patent: Aug. 18, 1998

[54] GARMENT HAVING AN EXTERNAL ENVELOPE AND AN IMPERVIOUS PART INSIDE THE EXTERNAL ENVELOPE

[76] Inventor: Georges Pessey, Les Riondes, La Clusaz, F-74220, France

[21] Appl. No.: 649,657

[22] PCT Filed: Sep. 27, 1995

[86] PCT No.: PCT/FR95/01240

§ 371 Date: Jun. 11, 1996

§ 102(e) Date: Jun. 11, 1996

[87] PCT Pub. No.: WO96/09777

PCT Pub. Date: Apr. 4, 1996

[30] Foreign Application Priority Data

Sep. 28, 1994 [FR] France ..... 94 11803

[51] Int. Cl.[6] ..... A41D 1/06; A41D 1/02

[52] U.S. Cl. ..... 2/227; 2/69; 2/108

[58] Field of Search ..... 2/227, 228, 238, 2/85, 93, 69, 79, 80, 81, 82, 84, 87, 94, 96, 97, 108, 232, 270, DIG. 5

[56] References Cited

U.S. PATENT DOCUMENTS

| | | | |
|---|---|---|---|
| 1,143,282 | 6/1915 | King | 2/227 |
| 1,652,750 | 12/1927 | Wohlgemuth | 2/227 |
| 2,216,852 | 10/1940 | McMeekin | 2/227 |
| 2,274,270 | 2/1942 | Kalb | 2/227 |
| 4,017,910 | 4/1977 | Bente . | |
| 4,773,100 | 9/1988 | Kuo . | |
| 4,993,077 | 2/1991 | Robison | 2/79 |

FOREIGN PATENT DOCUMENTS

| | | | |
|---|---|---|---|
| 2302697 | 10/1976 | France . | |
| 2374860 | 8/1978 | France | 2/227 |
| 2393543 | 5/1979 | France . | |
| 2509499 | 9/1976 | Germany | 2/227 |

OTHER PUBLICATIONS

Cabela's 1994 Annual Fall Catalog, p. 70, Jacket.

*Primary Examiner*—Gloria M. Hale
*Attorney, Agent, or Firm*—Greenblum & Bernstein P.L.C.

[57] ABSTRACT

A garment includes a stretchable external envelope having an opening that is openable via a longitudinal slit. The opening is formed by two lateral borders which are spaced apart and closable such that the two lateral borders of the longitudinal slit are joined together by a fastener system. The garment also includes an impervious part inside the stretchable external envelope. The impervious part consists of a panel surrounded by an upper border, a lower border, and two side borders. Edges of the lateral borders of the impervious part are connected to edges of the lateral borders of the longitudinal slit in the external envelope.

15 Claims, 7 Drawing Sheets

Fig. 8
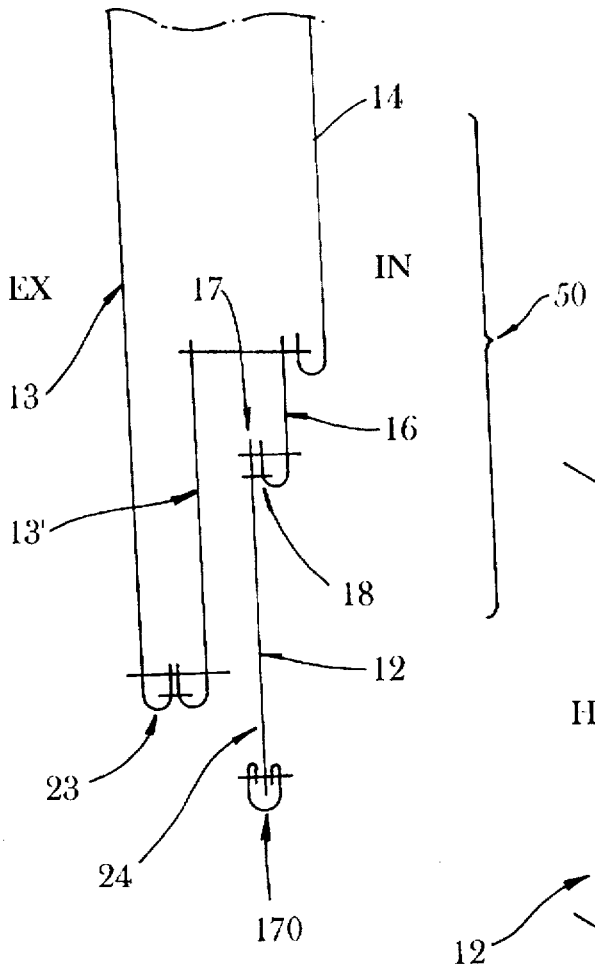
Fig. 9a
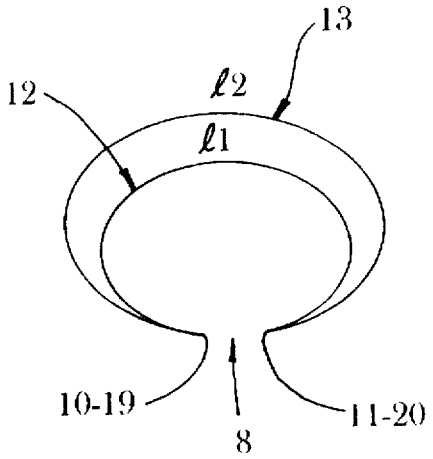
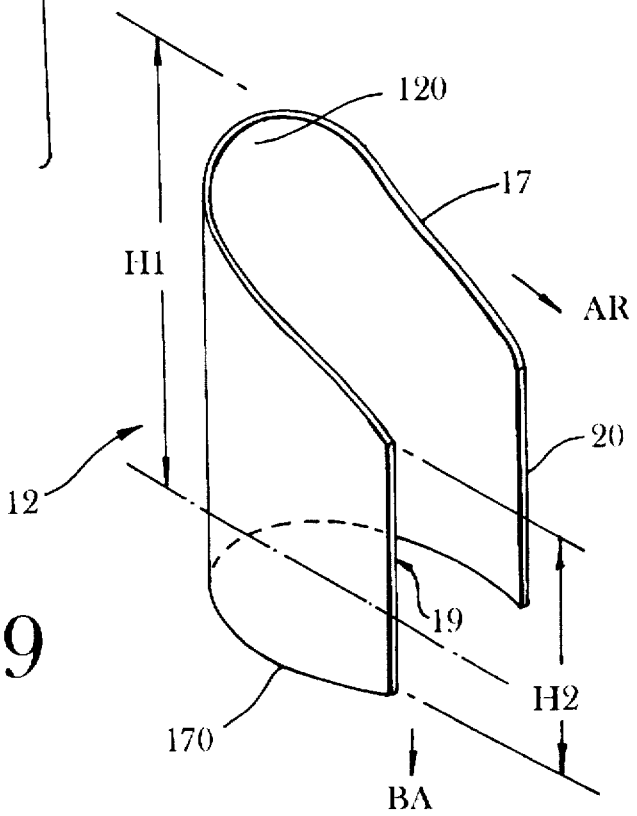
Fig. 9

GARMENT HAVING AN EXTERNAL ENVELOPE AND AN IMPERVIOUS PART INSIDE THE EXTERNAL ENVELOPE

BACKGROUND OF THE INVENTION

1. Field of the Invention

The present invention involves garments and concerns more particularly an improvement for a garment, types of trousers or anorak, containing an impervious part.

2. Discussion of Background

Garments are becoming more and more well designed and comfortable. Manufacturers compete to offer customers models suitable for their use, e.g., sports, like garments worn by skiers. In the field of ski apparel, it has been already proposed that trousers be totally made with stretchable material so that the garment fits on the legs of skiers. This type of garment is now tending to be replaced with more comfortable trousers which do not cling onto the legs of the user or, at least, their whole legs, to give freer and better movement. These garments, however, suffer from the problem of imperviousness of the garment against snow that can come up from the bottom of the trousers.

To remedy those inconveniences, manufacturers disposed inside the bottom of the trousers, a snow-guard tube made with a nylon fabric. The hem of the snow-guard tube is gathered with an elastic band to be disposed around the boot of the skier. This type of snow-guard tube is, for example, disclosed by French Patent Publication No. 2 393 543. In such realization, the bottom of the trousers contains, moreover, a lateral slit permitting, after opening, to dispose the snowguard tube around the collar of the boot, around which the slit must be carefully closed then. This type of disposal presents, of course, a certain number of inconveniences like, for example, disposing the snow-guard over the boot, which is not an easy operation with actual boots containing a series of buckles, without listing its detrimental effect on imperviousness well known to users. Besides, it is not rare to have to leave open the lateral slit because the bottom part of the trousers is too small. This type of garment is not satisfying from a comfort, imperviousness, or design point of view.

SUMMARY OF THE INVENTION

The present invention resolves the inconveniences described above and proposes an improvement which is simple, not too expensive, and satisfying from the comfort and imperviousness point of view.

Thus, the garment of the invention is composed of an external envelope having a longitudinal slit. In the opened position, two lateral borders of extension of the envelope are separated. In a closed position, two lateral borders of the slit are fixed by a fastening system. The garment also includes an impervious part disposed inside of the external envelope, and wherein the impervious part is composed of a face limited peripherally by an upper edge and a lower edge and two lateral borders. The lateral borders of the impervious part are connected to the lateral borders of the slit of the external envelope to be fixed on.

According to another embodiment, the impervious part is made with a soft material whose lower border contains elastic means, whereas another embodiment involves a bi-stretchable material like neoprene.

According to one embodiment of the invention, the garment is a pair of trousers whose lower portion has an impervious part on each leg.

According to a particular embodiment, an impervious face involves a central projection at front which extends to knee level. Thus, the impervious face extends laterally from the central projection to behind and to the bottom to join the longitudinal slit of the external envelope on which the face is fixed by its lateral borders.

According to an advantageous embodiment, the upper border of the impervious face is connected to an internal lining by way of an intermediate band with stretch material.

In addition, the width of the impervious face can be less at a given width of the external envelope, and the fasten system of the slit can be a slide fastener.

Of course, the invention can find application in other types of garments like, for example, an anorak.

BRIEF DESCRIPTION OF THE DRAWINGS

Other characteristics and advantages of the invention will be clear from the description of the drawings which are given only as non-restrictive examples.

FIGS. 1 to 12 illustrate a first application of the invention which is a pair of trousers.

FIGS. 1 to 9 present a first embodiment.

FIG. 1 is a front view.

FIG. 2 is a back view.

FIG. 3 is a side view.

FIGS. 4 and 5 are back views of the lower part of the trousers, in its opened position, FIG. 4, and in its closed position, FIG. 5.

FIGS. 6 and 7 are sectional views of a larger scale along line (AA) of FIGS. 2 and 3. FIG. 6 shows the trousers with the longitudinal slit closed with the slide fastener, whereas FIG. 7 shows the trousers in its opened position, the slide fastener having been pulled up.

FIG. 8 is a sectional view along line (BB) of FIGS. 3 and 6.

FIG. 9 shows the impervious part in a perspective view.

FIG. 9*a* is a transversal diagrammatic section.

FIG. 10 is similar to FIG. 3 showing a second embodiment.

FIGS. 11 and 12 show a third embodiment, FIG. 11 being similar to FIG. 3, whereas FIG. 12 is similar to FIG. 4.

FIG. 13 is a perspective of a fourth embodiment involving an anorak having sleeves with impervious parts.

FIGS. 14 to 16 show a fifth embodiment involving an anorak in which the waist has an impervious part.

DESCRIPTION OF THE PREFERRED EMBODIMENT

Figure 1:
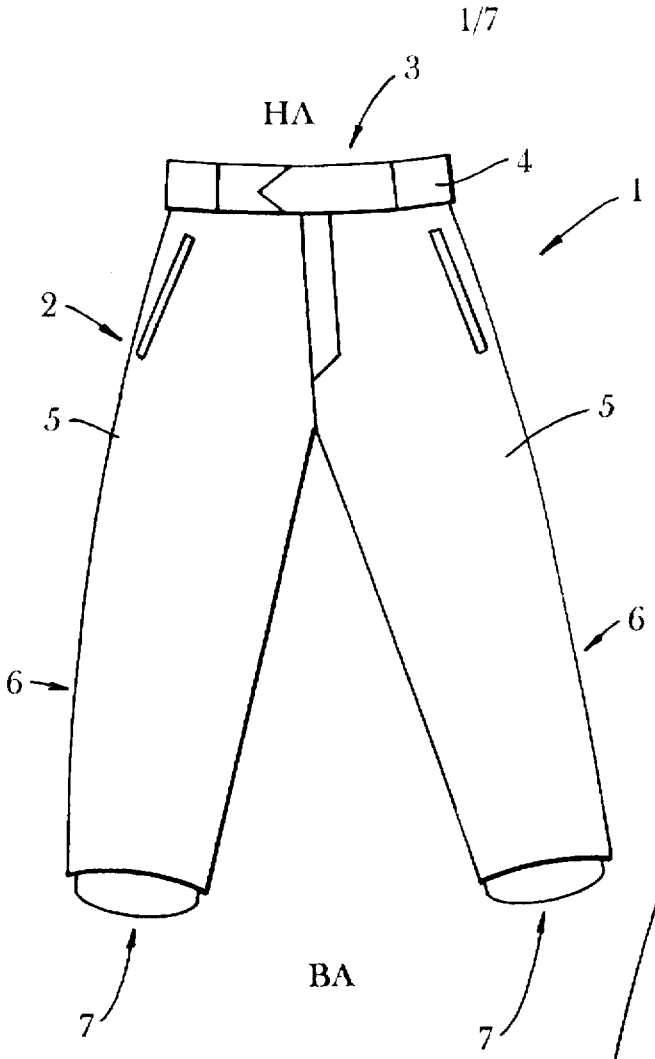
Figure 2:
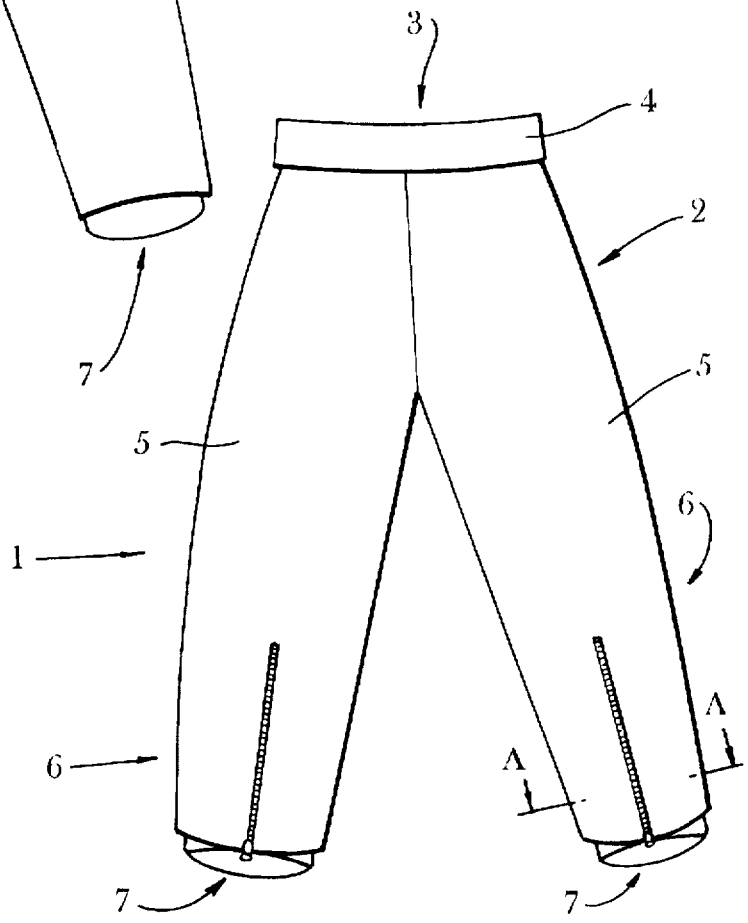
Figure 3:
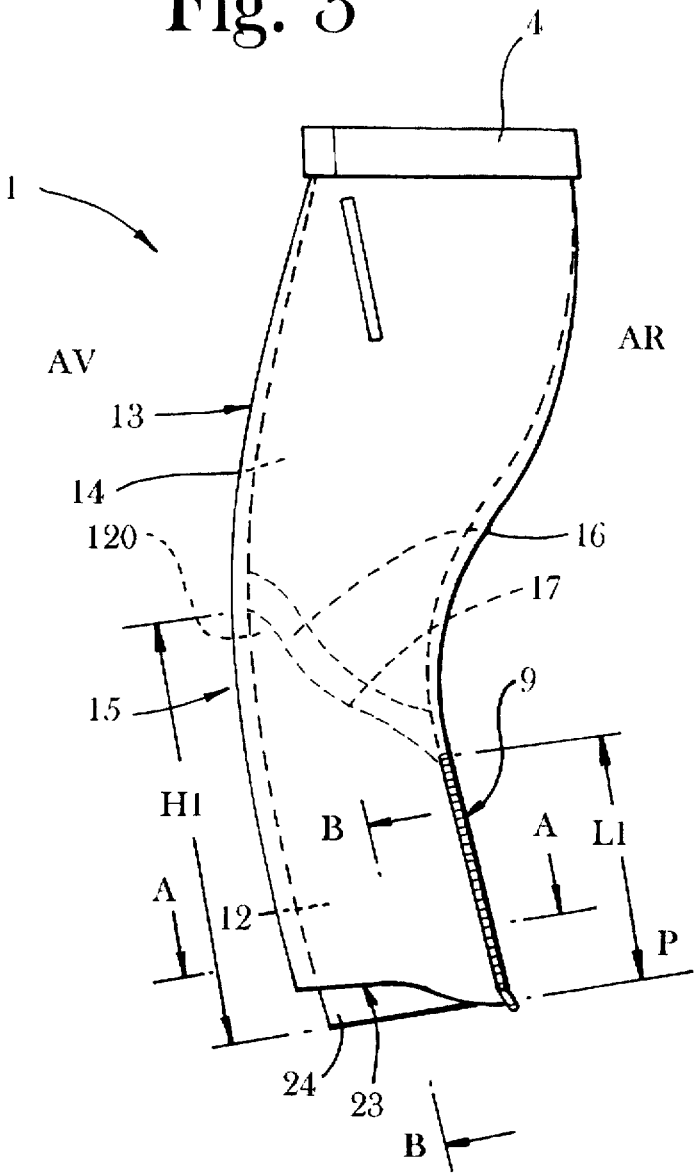

FIGS. 1 to 12 illustrate a first application of the invention in the form of a pair of trousers and more particularly a pair of trousers intended to be worn for skiing. The trousers of the invention (1) involve a well known upper part (2) comprising an upper opening (3) with a belt (4) which is extended to the bottom by two legs (5). Each of the legs (5), which has the form of a longitudinal tubular sheath, includes at its lower end a lower opening (7) at the bottom (BA) and a longitudinal back slit (8) opening into the sheath (IN), equipped with a slide fastener (9).

The slide fastener (9) allows the slit to be in an open position (see FIG. 4) in which one of the two lateral borders (10, 11) can be removed and, in a closed position (see FIG.

Figure 4:
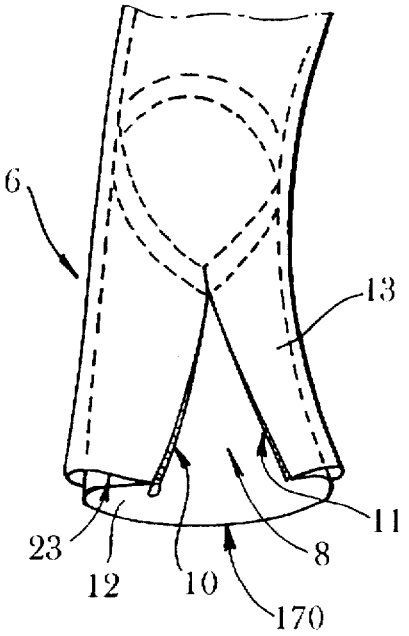
Figure 5:
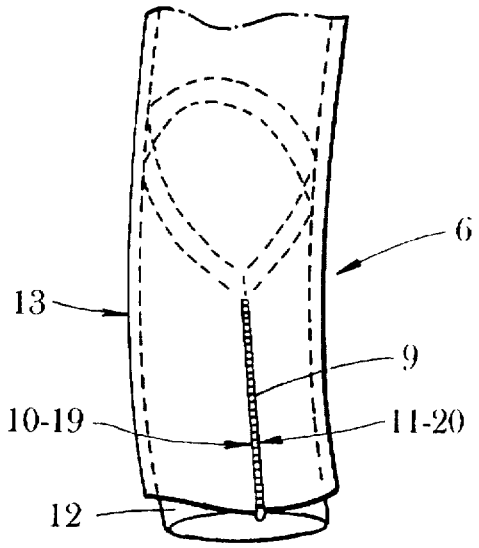

5) in which the two borders (10, 11) are connected. As seen in FIGS. 4 and 5, the slit extends through only a portion of the external envelope such that the lateral borders are connected to each other at a base. The open position permits the passage of a foot with a boot. In the closed position, the lower opening (7) is partially closed to approach the lower end of the leg of the trousers.

According to a characteristic of the invention, each of the legs (5) includes an impervious part (12) disposed inside a lower part (6) close to the opening (7). For example, each of the legs (5) includes an external envelope (13) made of a material that can be any type like, for instance, polyamide, polyester or other, and presents at the upper part an inside lining (14) extending from the bottom of the belt (4) to the knee level (15).

The lining (14) ensures the thermal comfort of the trousers and is, for example, formed by a material fabric and an insulation bonded together, and is joined, on the one hand, to the external envelope (13), and on the other hand, to the impervious part (12) by way of an intermediate material band (16) made advantageously of a bi-stretchable material. So, the lining (14) is extended to the bottom by the impervious part (12). The impervious part is made of an elastic material and more particularly bi-stretchable material. The material used is advantageously neoprene, widely known, and which is generally used for manufacturing of one piece diving suits. The face forming the impervious part is limited peripherally by an upper border (17) connected to a lower border (170) by two lateral borders (19, 20), the upper border (17) being connected by a seam (18) to the intermediate band (16) when its two lateral back borders (19, 20) are, according to the invention, connected by a seam (21) to the two borders (10, 11) of the back slit (8) containing the slide fastener (9). So, the back slit (8) is common to the external envelope (13) and to the impervious part (12). The slide fastener (9) is thus common to the external envelope (13) and to the impervious part (12).

The impervious part (12) includes a central front projection (120) extending to the top above knee level (15) in order to insure the protection and the comfort of the front part of the leg of the user. So, the upper border (17) extends laterally to the back (AR) and to the bottom (BA) to join the corresponding back border (19, 20) Each of the back borders (19, 20) extend vertically to a height (H2) less than the height (H1) of the front portion where the central front projection (120) is located. The height (H2) of the back borders (19, 20) of the impervious part is usually equal to the length (L1) of the opening formed by the back slit (8). Also, the height (H1) of the front part of the impervious face is such that it extends to the bottom beyond a lower border (23) of the external envelop (13) of the leg to form a projecting portion (24) to allow perfect fitting of the boot and to ensure good imperviousness.

In FIG. 8 the lower extremity (13) of the leg includes a double face (13') which extends inside (IN) and on which is seamed and held an internal set (50) comprised of the lining (14) and the intermediate band (16).

The lower opening (7) is edged peripherally by the lower border (23) of the external envelope (13), and also by the lower border (170) of the impervious part (12) and that the longitudinal slit (8) extends to the general plan (P) of the opening (7).

Figure 10:
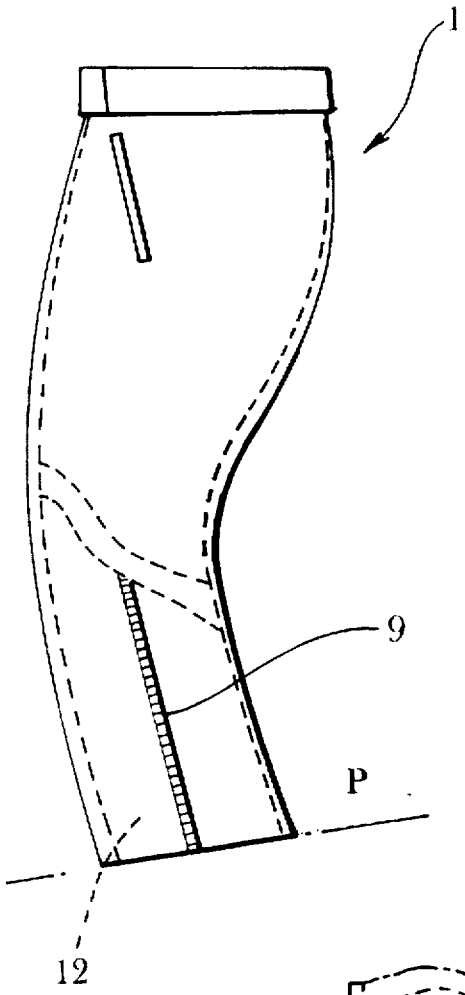

FIG. 10 illustrates a second embodiment in which the lower slit is disposed on the side instead of at the back.

Figure 11:
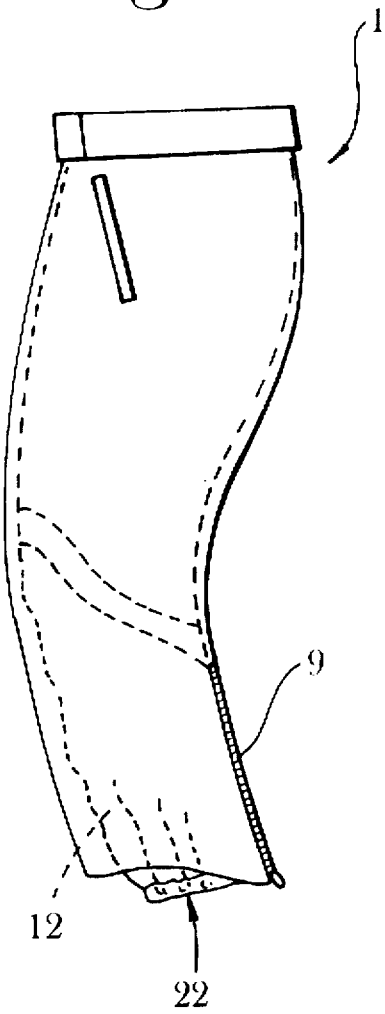
Figure 12:
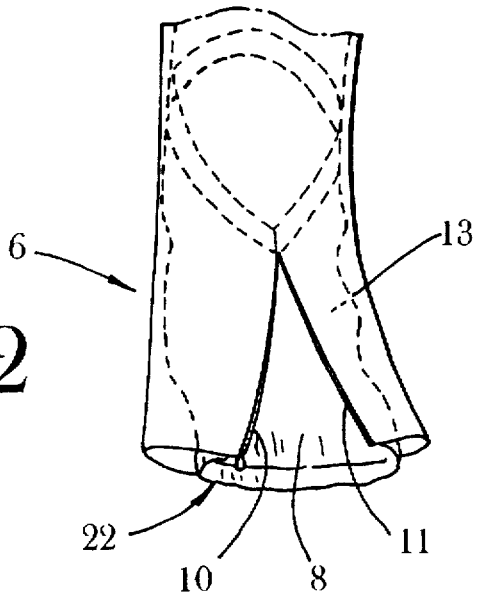

FIG. 11 illustrates a third embodiment in which the imperviousness of part (12) is not formed by an elastic bi-stretchable material, but is made of a tubular sheath of inelastic material like nylon. In this embodiment, the lower border (22) includes elastic means like elastic bands in a hem.

Figure 6:
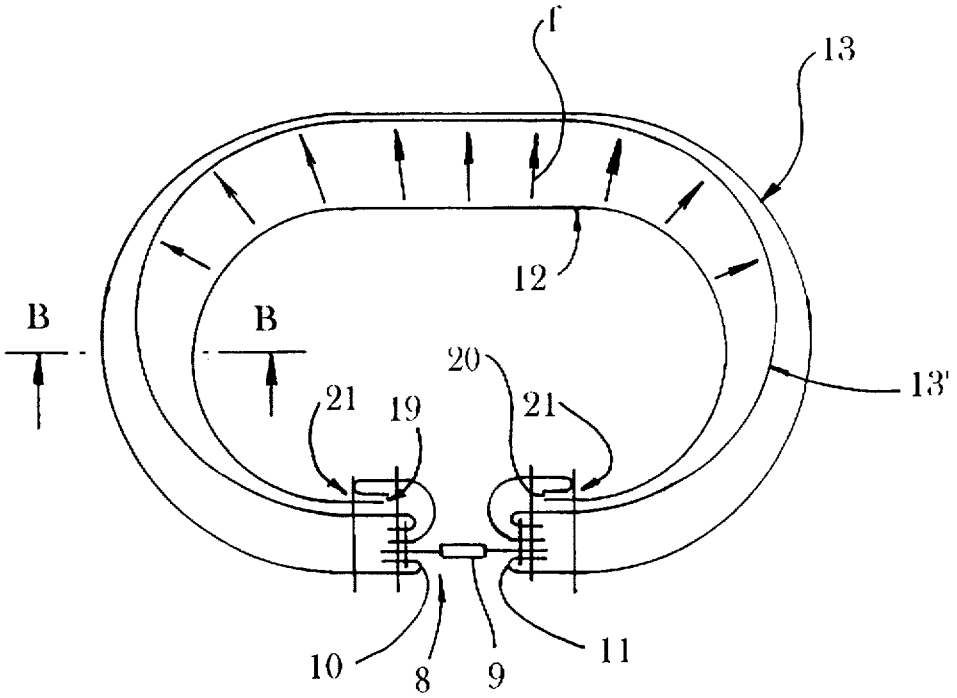
Figure 7:
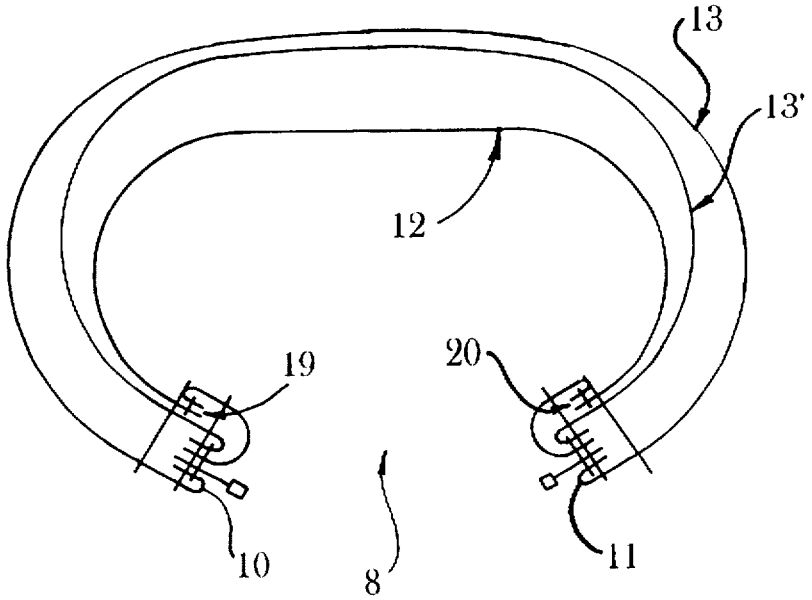

It is evident to ensure imperviousness, the impervious part should be able to adapt to the fitting volume and be able to extend by elasticity inside the envelope as it is shown by arrows *f* in FIG. 6 and by the broken line that represents an enlarged position of the impervious face. For this purpose 14695. S01 the unfolded width ($l_1$) of the imperviousness face is less than the unfolded width ($l_2$) measured at the same level (see FIG. 9*a*). As mentioned previously, the impervious face is advantageously made of neoprene with a thickness between 1 and 6 millimeters to ensure imperviousness, as well as the comfort and the protection of the skier's leg. The extendibility of the impervious part permits the impervious part to adapt to each style of ski boots, whatever the form and size of the collar above which it is located, and to ensure perfect imperviousness and holding.

The intermediate band (16) extends laterally to the back (AR) and toward the bottom (BA) from above the knee (15) to above the slit (8).

The invention can be used for garments other than trousers and can be, for instance, used in a garment designed to cover the upper part of the body, like an anorak (1'). FIGS. 13 to 16 illustrate an anorak in which similar elements with respect to the trousers bear the same reference numbers.

Figure 13:
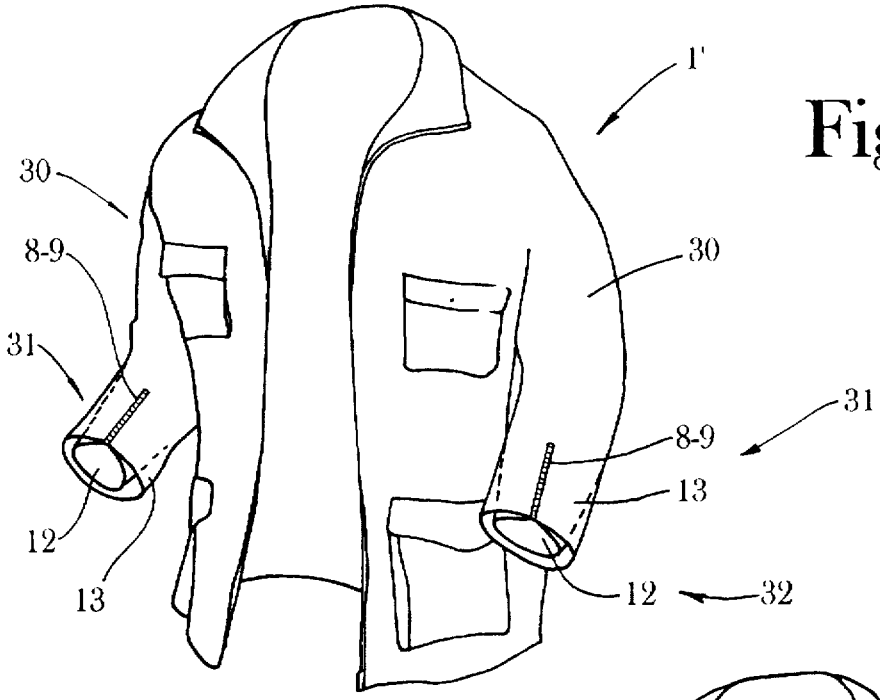
FIGS. 13 to 16 illustrate another application of the invention in the form of an anorak.

In FIG. 13, each of the sleeves (30) includes at its lower extremity (31) a longitudinal slit (8) containing a slide fastener (9) and which lateral borders of the impervious part (12) are, like before, fixed to the lateral borders of the slit (8). The impervious part (12) is designed to make the anorak wrists (32) impervious.

Figure 14:
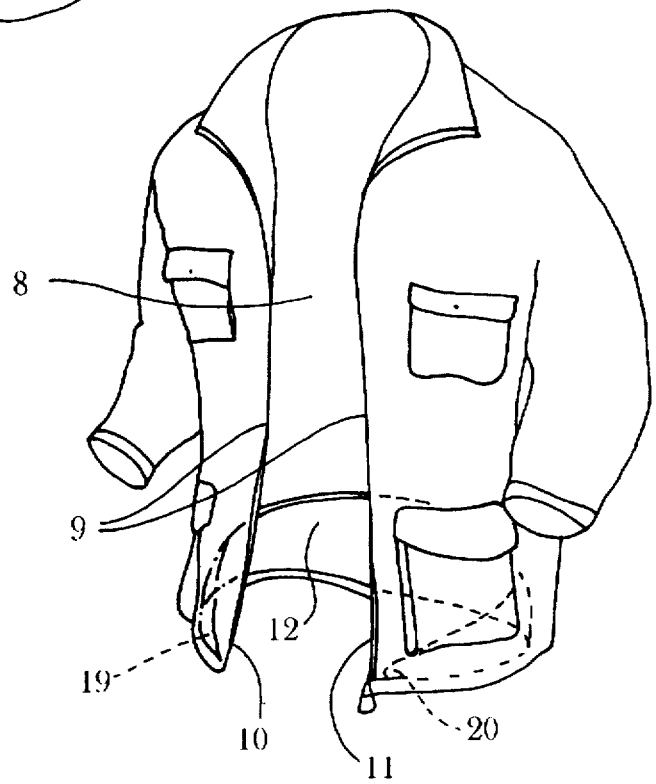
Figure 15:
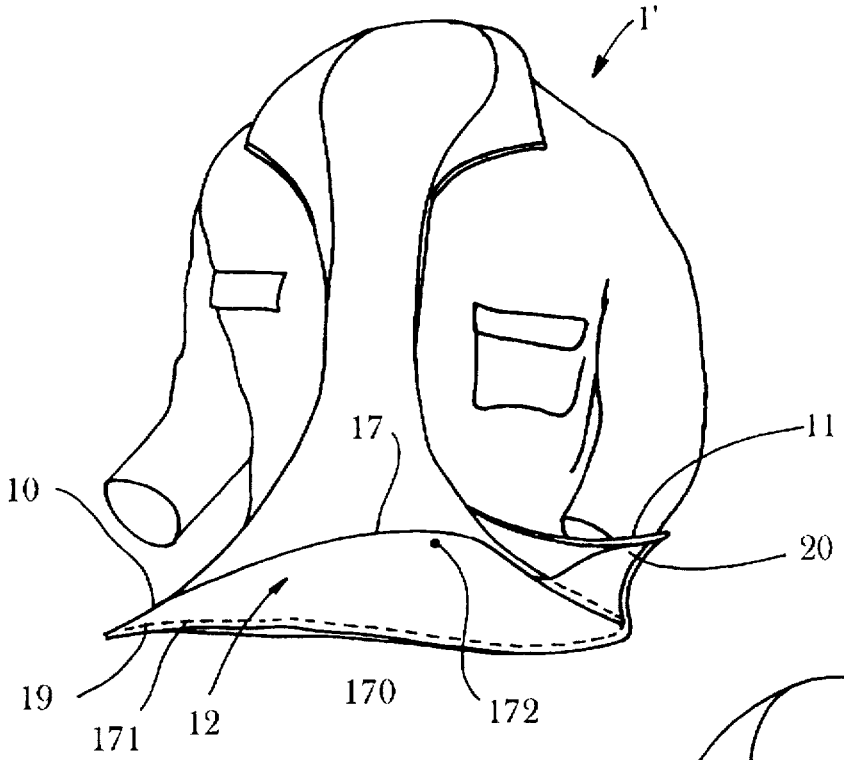
Figure 16:
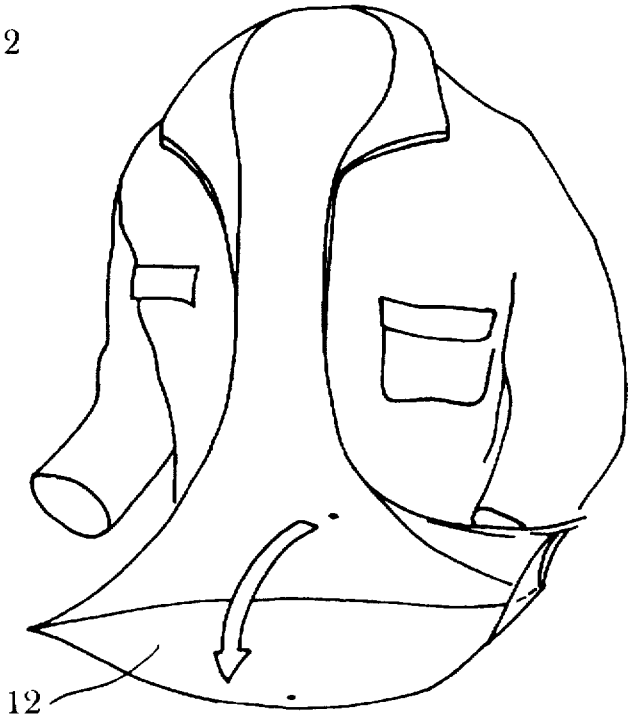

FIGS. 14 to 16 illustrate another embodiment involving an anorak in which the impervious part (12) is designed to ensure the thermal comfort and the imperviousness of the back part of the garment and more specifically the part located on the back of the user. In this embodiment, the impervious part (12) is such that its lateral borders (19, 20) are fixed to lateral borders (10, 11) of the front longitudinal slit (8) which includes closing means like slide fastener (9).

The impervious part (12) is advantageously made of neoprene. This impervious part has the general form of a triangle whose lower border (170) is free. Thus, the impervious part (12) is able to take two positions, an up position such as shown in FIG. 15, and a down position such as shown in FIG. 16. In the up position, the impervious part is designed to ensure the imperviousness and the comfort at the back level, while in the down position, it fits the buttocks to ensure these same functions. This embodiment can be provided with a system for holding the impervious part in the up position, like, for instance, a central press-button (172).

It is evident that the fastener system of the longitudinal slit (8) may comprise a slide fastener and can be any other type of fastener system, like, for example, self clutch type, or press-button, laces or others.

Of course, the invention is not limited by the embodiments described and shown as examples.

I claim:

1. A garment, comprising:

an external envelope having two lateral borders which form a longitudinal slit extending through only a portion of the external envelope such that the lateral borders are connected to each other at a base, the lateral borders having a fastener system, the longitudinal slit being capable of forming an opening in an open position in which the lateral borders are separated except at the base, and the longitudinal slit also being capable of assuming a closed position in which the lateral borders of the longitudinal slit are connected to each other by the fastener system;

at least one water impervious part located inside the external envelope, the at least one impervious part comprising a face having an upper border, a lower border, and two lateral borders; and wherein edges of the two lateral borders of the impervious part are connected to edges of the two lateral borders of the longitudinal slit of the external envelope.

2. The garment of claim 1, wherein the at least one impervious part comprises an inelastic material whose lower border includes an elastic member.

3. The garment of claim 1, wherein the at least one impervious part comprises a bi-stretchable material.

4. The garment of claim 3, wherein the at least one impervious part is made of neoprene.

5. The garment of claim 1, wherein the fastener system of the lateral borders of the external envelope comprises a slide fastener.

6. The garment of claim 1, wherein the lateral borders are integrally connected to each other at the base.

7. The garment of claim 1, wherein the lateral borders are permanently connected to each other at the base.

8. The garment of claim 1, wherein the lateral borders are integrally connected to each other such that when the longitudinal slit is completely open, the lateral borders are capable of forming a "V".

9. Trousers, comprising:

legs with lower ends;

each leg comprising an external envelope having two lateral borders which form a longitudinal slit, the lateral borders having a fastener system, the longitudinal slit being capable of forming an opening in an open position in which the lateral borders are separated, and the longitudinal slit also being capable of assuming a closed position in which the lateral borders of the longitudinal slit are connected to each other by the fastener system;

each leg further comprising at least one water impervious part located inside the external envelope at the lower end of each leg, the at least one impervious part comprising a face having an upper border, a lower border, and two lateral borders; and wherein edges of the two lateral borders of the impervious part are connected to edges of the two lateral borders of the longitudinal slit of the external envelope.

10. The garment of claim 9, wherein the at least one impervious part includes a central front projection which extends to knee level.

11. The garment of claim 10, wherein the upper border of the at least one impervious part extends from the central front projection to a back of each leg and to a bottom of each leg to connect with the longitudinal slit of the external envelope.

12. The garment of claim 11, further comprising an internal lining which is connected to the at least one impervious part by an intermediate band of elastic material.

13. The garment of claim 12, wherein an unfolded width of the at least one impervious part is less than an unfolded width of the external envelope.

14. An anorak, comprising:

sleeves with lower ends;

each sleeve comprising an external envelope having two lateral borders which form a longitudinal slit, the lateral borders having a fastener system, the longitudinal slit being capable of forming an opening in an open position in which the lateral borders are separated, and the longitudinal slit also being capable of assuming a closed position in which the lateral borders of the longitudinal slit are connected to each other by the fastener system;

each sleeve further comprising at least one water impervious part located inside the external envelope at the lower end of each sleeve, the at least one impervious part comprising a face having an upper border, a lower border, and two lateral borders; and wherein edges of the two lateral borders of the impervious part are connected to edges of the two lateral borders of the longitudinal slit of the external envelope.

15. The garment of claim 14, wherein the anorak comprises a waist portion with a lower end, and wherein the at least one impervious part comprises an impervious part located at the lower end of the waist portion.

* * * * *